United States Patent [19]

Noll

[11] Patent Number: 4,509,678

[45] Date of Patent: Apr. 9, 1985

[54] THERMALLY-POWERED CONTROL MECHANISM

[76] Inventor: Robert W. Noll, 800 Wikiup Rd., Santa Rosa, Calif. 95401

[21] Appl. No.: 576,067

[22] Filed: Feb. 1, 1984

[51] Int. Cl.[3] ..... F24F 7/00

[52] U.S. Cl. ..... 236/49; 98/40.25; 165/24

[58] Field of Search ..... 236/49; 98/40 VT, 40 D; 165/24

[56] References Cited

U.S. PATENT DOCUMENTS 3,643,862 2/1972 Byrne ..... 236/49 X 4,231,513 11/1980 Jance et al. ..... 236/49

*Primary Examiner*—William E. Wayner

*Assistant Examiner*—John Sollecito

*Attorney, Agent, or Firm*—Townsend and Townsend

[57] ABSTRACT

A room air diffuser control mechanism is provided which is operated by two thermally powered thermostatic actuator elements, one reacting to the room air temperature, and the other reacting to the supply air temperature. When the supply air temperature is cool (e.g., less than 68° F.), the supply air element is retracted and its linkage system is rendered inoperative. The room air element, through its linkage system, reacts to control the room temperature by varying the area of an air diffusion discharge opening. When the supply air temperature is warm (e.g., greater than 78° F.), the supply air element reacts to disengage the room air element linkage system, and to move the air diffusion discharge opening to an adjustable, predetermined position. In this mode, the room air element does not affect the discharge opening regardless of the temperature of the room air.

3 Claims, 7 Drawing Figures

THERMALLY-POWERED CONTROL MECHANISM

FIELD OF THE INVENTION

This invention relates generally to heating, ventilation and air conditioning systems, and more specifically to control devices for room air diffusers.

BACKGROUND OF THE INVENTION

Room air diffusers and vents are well known. The simplest of these have no self-contained mechanism for regulating air volume whatsoever, but serve only as a final outlet for supply air to a room. Other types of diffusers include a control mechanism, but require electrical wiring, pneumatic piping or increased system pressure to power the mechanism, thereby limiting their application.

Some known diffusers include a self-contained, thermally-powered control mechanism. U.S. Pat. No. 4,231,513 (jointly invented by the inventor herein and Robert L. Vance, and assigned to Accutherm, Inc. of Novato, Calif.) is an example of such a device. That device utilizes a pair of thermostatic actuator elements, one sensing room air temperature and the other sensing supply air temperature, which are mechanically connected to and control the size of the diffuser opening. In the air cooling mode, the supply air element does not operate, and the size of the diffuser opening is controlled by the room air element only. In the air heating mode, however, the supply air element reacts to the warm air to result in a full open diffuser position. The room air element then reacts to the rise in room temperature by completely closing the diffuser (cutting off the warm air supply), or by first closing and then completely reopening the diffuser, which uncontrollably diverts more warm air into an already warm room.

SUMMARY OF THE INVENTION

A room air diffuser control mechanism is provided which is operated by two thermal powered thermostatic actuator elements, one reacting to the room air temperature, and the other reacting to the supply air temperature. When the supply air temperature is cool (e.g., less than 68° F.), the supply air element is retracted and its linkage system is rendered inoperative. The room air element, through its linkage system, reacts to control the room temperature by varying the area of an air diffusion discharge opening. When the supply air temperature is warm (e.g., greater than 78° F.), the supply air element reacts to disengage the room air element linkage system, and to move the air diffusion discharge opening to an adjustable, predetermined position. In this mode, the room air element does not affect the discharge opening regardless of the temperature of the room air.

DETAILED DESCRIPTION OF A PREFERRED EMBODIMENT

Figure 1:
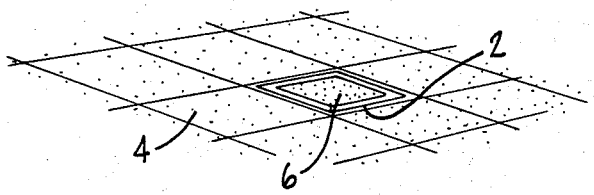
FIG. 1 is a bottom perspective view of a typical room air diffuser in place in a ceiling.

Referring now the FIG. 1 with greater particularity, a bottom perspective view of a typical room air diffuser 2 in place in a ceiling 4 is shown. In this view, the discharge opening and its control mechanism are hidden from sight by appearance panel 6. Diffuser 2 is subject to being preferentially sized and placed in any number of locations in a ceiling, depending on the ventilation requirements of a given room.

Figure 2:
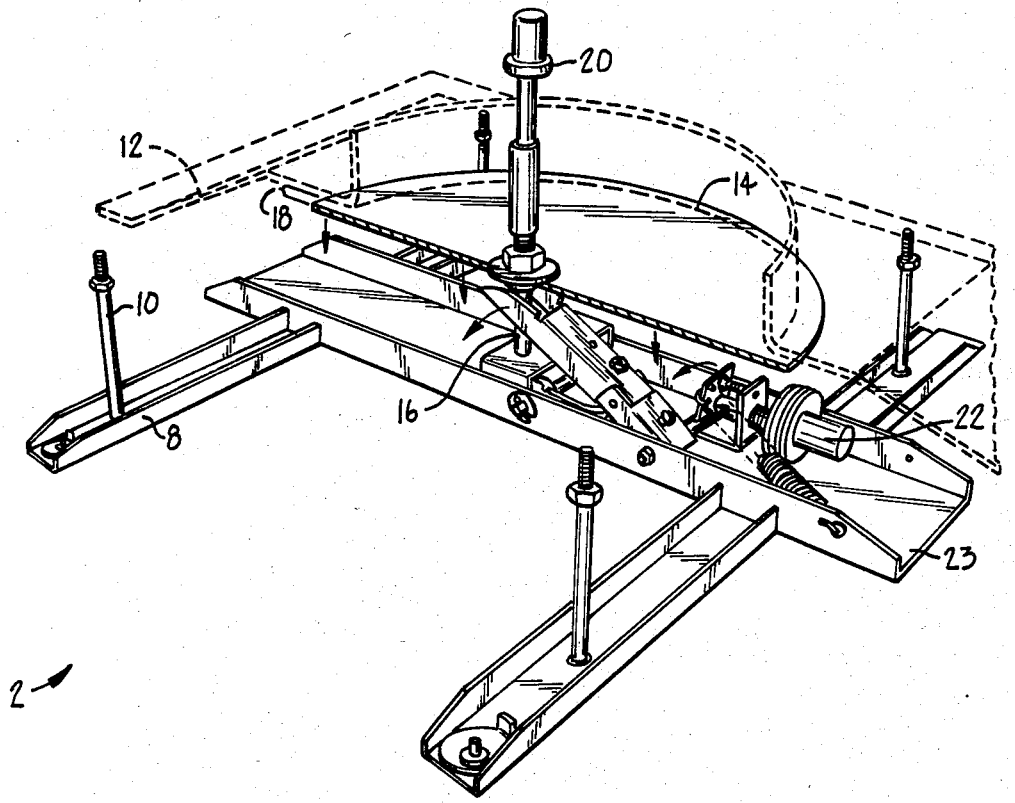
FIG. 2 is a partially cutaway perspective view of a room air diffuser with the thermally powered control mechanism of this invention.

Referring now to FIG. 2 with greater particularity, a partially cutaway perspective view of a room air diffuser with the thermally powered control mechanism of this invention is shown. Diffuser 2 includes locking bracket 8 with a plurality of locking rods 10 securing the diffuser to its external casing 12 (shown in phantom). Diffusion disk 14 is slidably mounted on center post 16 and defines a discharge opening 18 between itself and external casing 12.

The location of diffusion disk 14 up or down post 16 determines the size of the air diffusion discharge opening 18 and, hence, the volume of air entering the room. Movement of disk 14 is performed by a pair of thermally powered thermostatic actuator elements and their corresponding mechanical linkages to the disk. Supply air thermostatic actuator element 20 is disposed above disk 14 in the supply air ductwork, while room air thermostatic actuator element 22 is disposed below and to the side of disk 14, where it is exposed to the room air via induction trough 23.

A discussion of the operation of supply air element 20 and room air element 22, and their effect on disk 14, is best accomplished by reference to particular heating and cooling environments. Accordingly, FIGS. 3*a* and 3*b* will serve to illustrate the operation of the control mechanism in a summer time (cool supply air) environment, while FIGS. 4*a*, 4*b* and 4*c* will serve to illustrate the operation of the control mechanism in a winter time (warm supply air) environment.

Figure 3A:
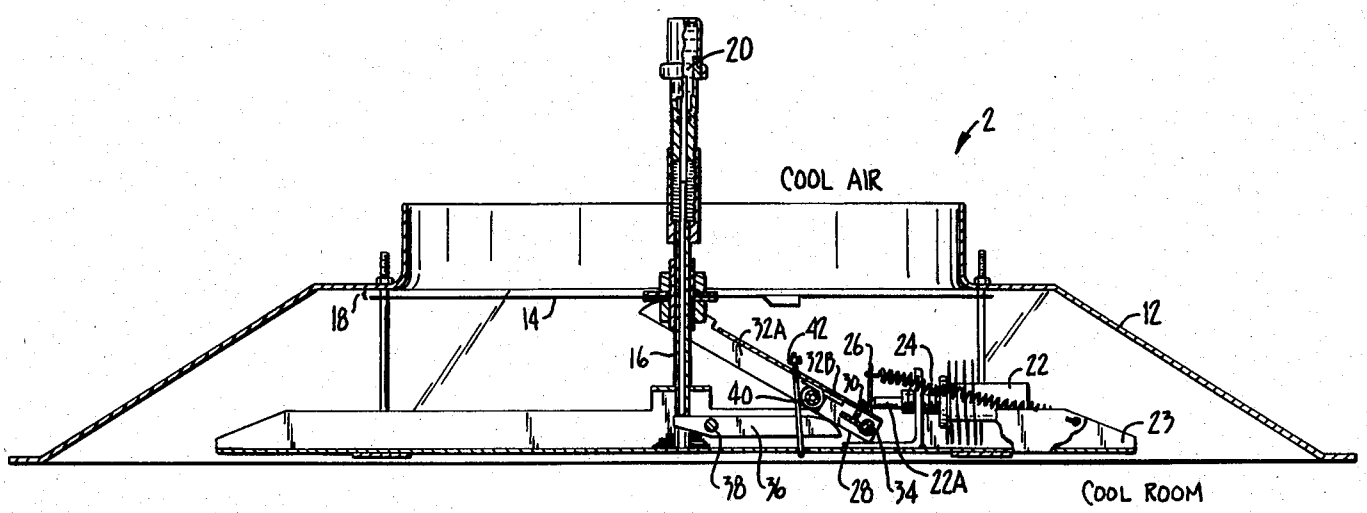
FIGS. 3*a* and 3*b* are a pair of cross-sectional views of the thermally powered control mechanism of this invention, showing its operation in a cooling mode.

Referring now to FIG. 3*a* with greater particularity, a cross-sectional view of the air diffuser is shown, with its control mechanism configured as it would be in a cool supply air/cool room air environment. Such an environment exists, for example, on a summer morning, before the room has been warmed by the sun, and with the central ventilation system in its air conditioning (cool air) mode.

In such a mode, supply air element 20 and its corresponding shaft and linkage are retracted, and have no effect on the positioning of diffusion disk 14. Rather, disk positioning is entirely controlled by room air element 22 and its shaft 22*a*. In a cool room environment, shaft 22*a* is retracted and room element return spring 24 provides tension to axle arm 26, which, via the overload bracket 28 against set screw 30, acts as a lever against jointed arm 32*a*, *b* about axis 34. Arm 32*a*, *b* at its remote end supports disk 14 at a relatively high position on center post 16, rendering discharge opening 18 very small. Thus, in such a configuration, little if any supply air would be allowed into the room.

Figure 3B:
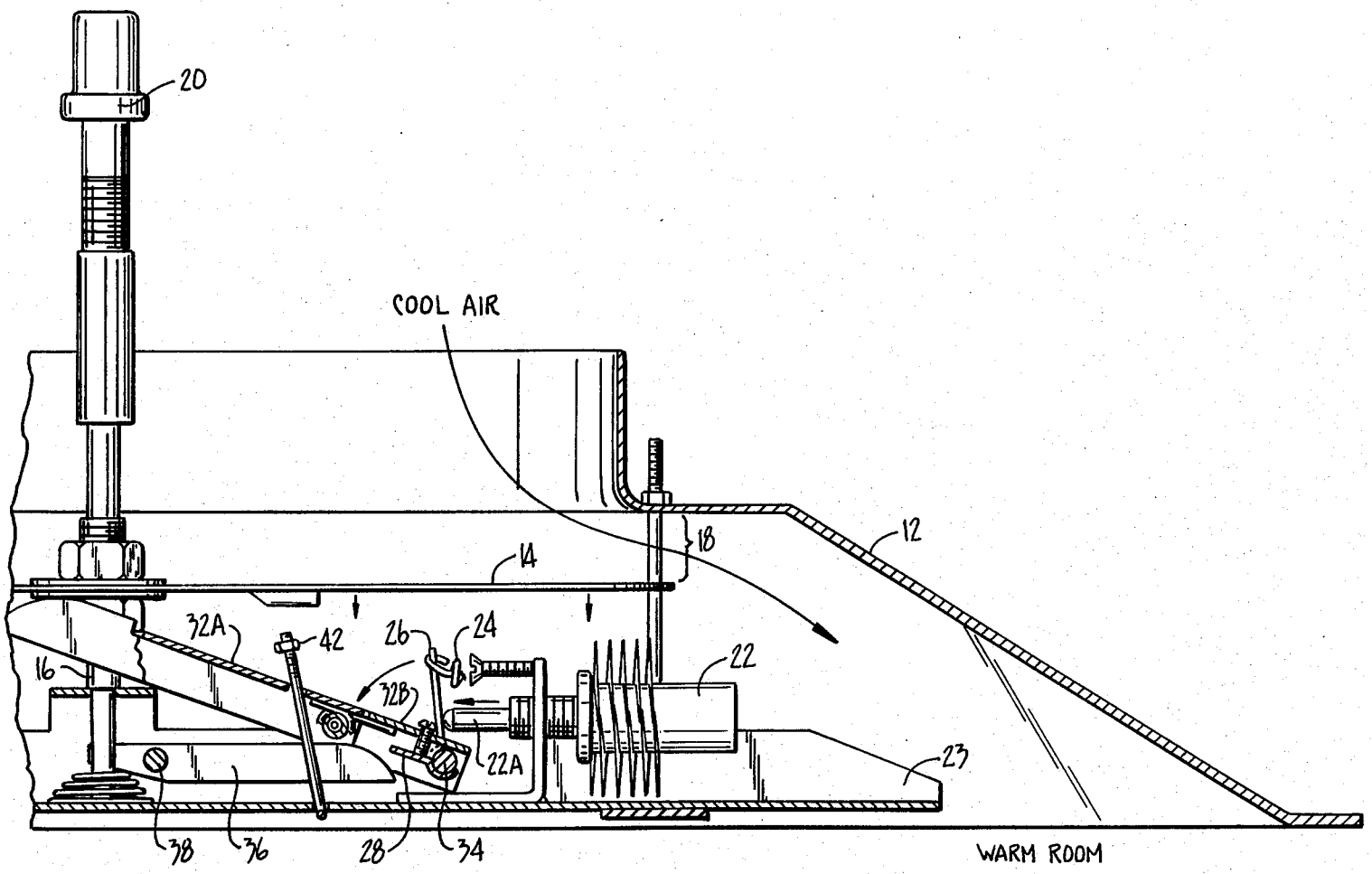

FIG. 3*b* illustrates the system in a similar environment, but after the room air has been warmed by the sun, thus necessitating the introduction of cool supply air to the room. This is accomplished by room air element 22 responding to the increase in room temperature and extending its shaft 22*a* against axle arm 26, moving it and overload bracket 28, so that jointed arm 32*a, b* is moved down, as indicated by the arrows. This lowers diffusion disk 14, allowing the cool supply air to enter the room through expanded discharge opening 18. Room air element 2 is then further responsive to the subsequently reduced room air temperature, and can retract shaft 22*a* accordingly, thereby regulating the room air temperature.

Figure 4A:
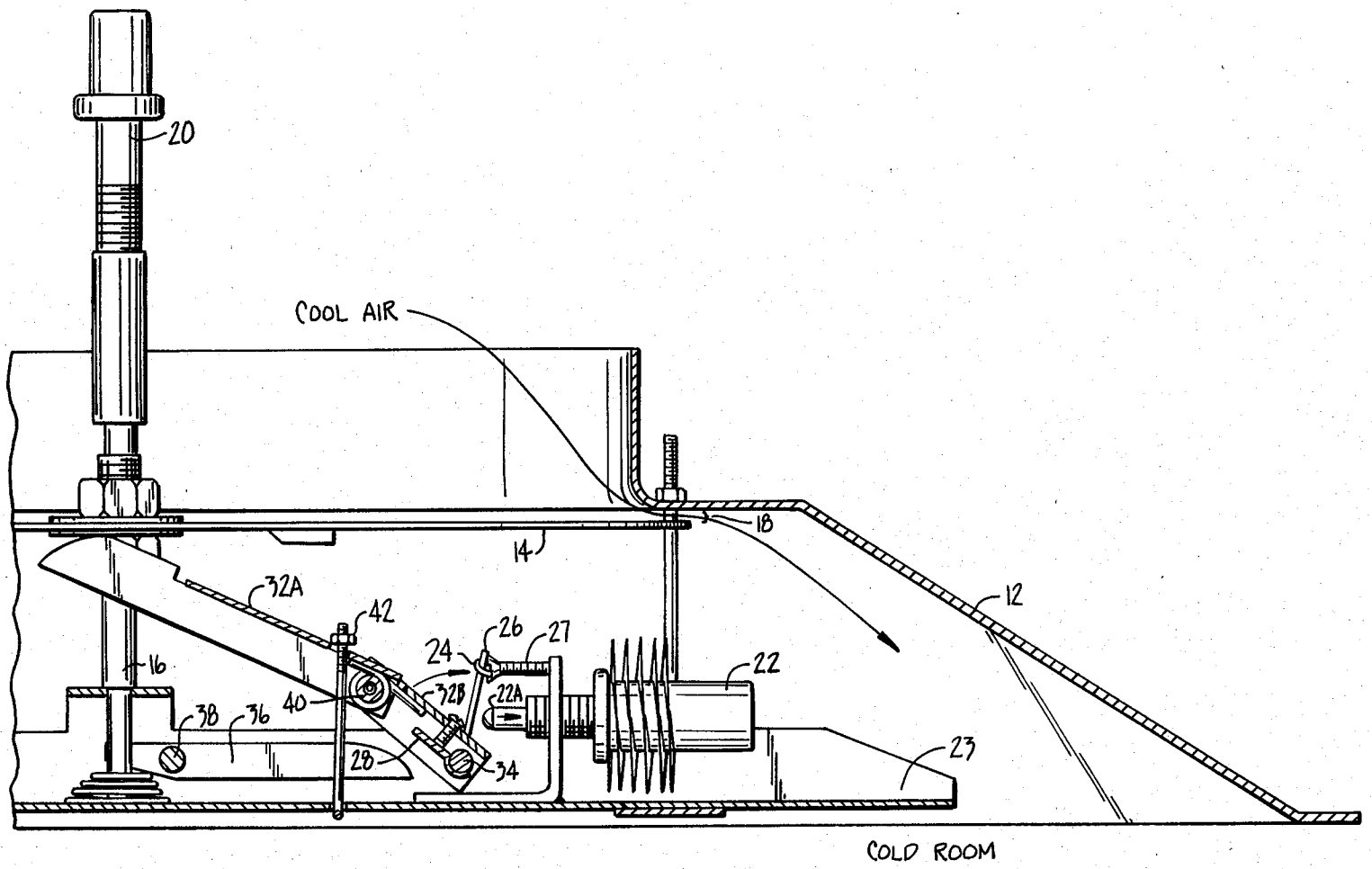
FIGS. 4*a* through 4*c* are a set of cross-sectional views of the thermally powered control mechanism of this invention, showing its operation in a heating mode.
Figure 4B:
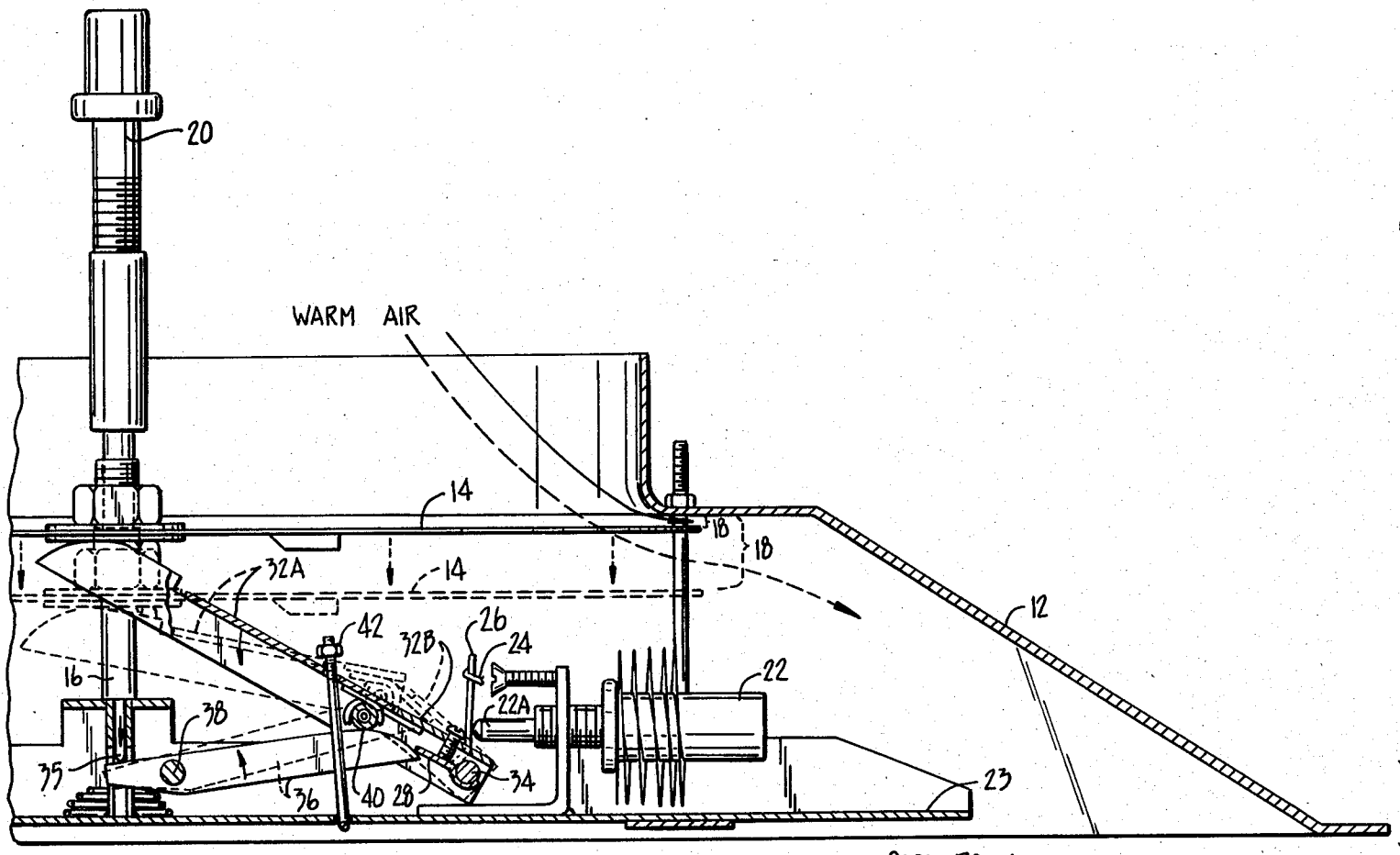
Figure 4C:
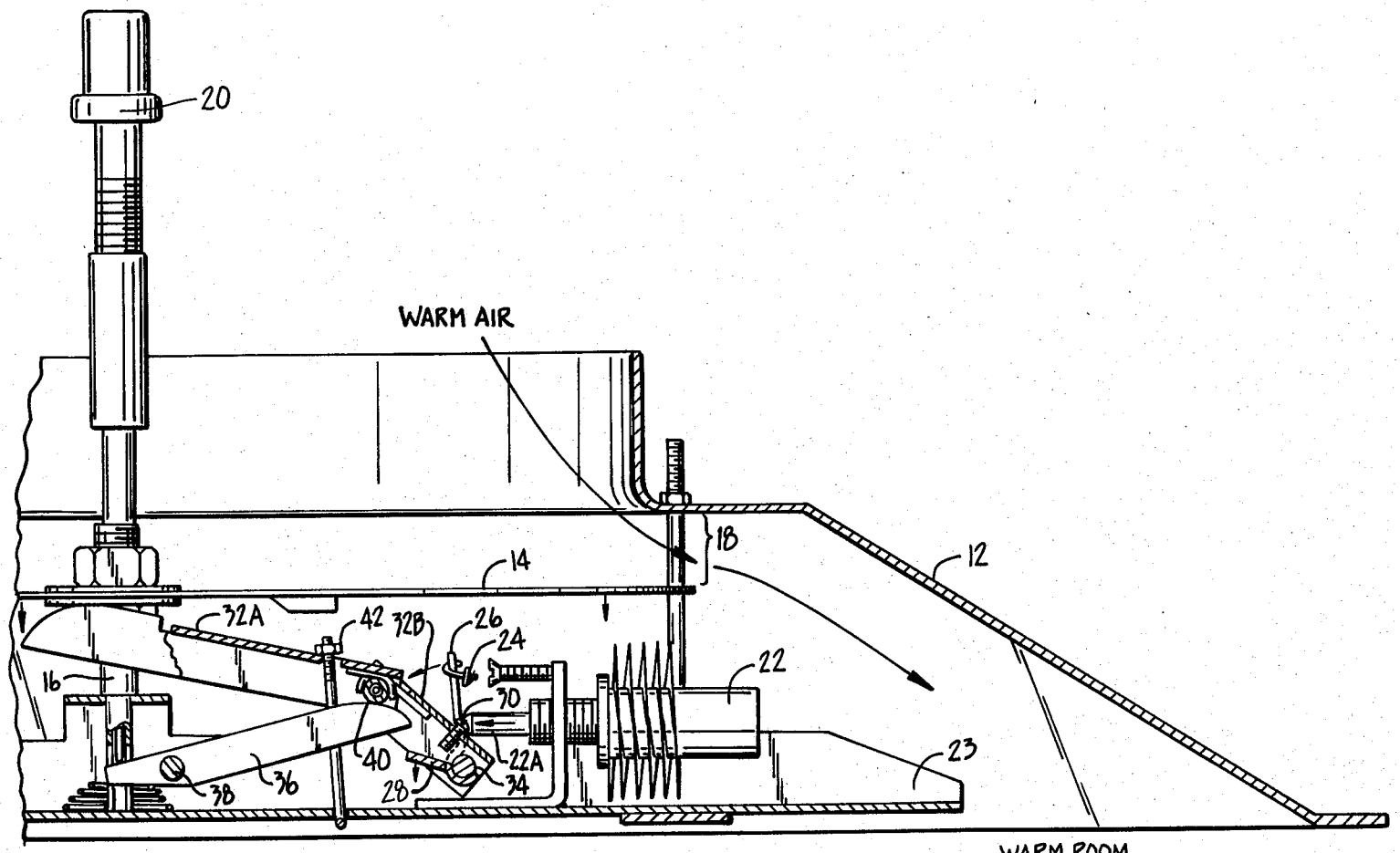

A description of the operation of the control mechanism in a winter time (warm supply air) environment can be had by reference to FIGS. 4*a*, 4*b* and 4*c*. FIG. 4*a* is illustrative of a winter morning condition, when the room air is cold, and the supply air in the vicinity of the air diffuser is cool, having not yet been heated by the central heating system. Accordingly, FIG. 4*a* illustrates the relatively high diffusion disk 14 position with its correspondingly small discharge opening 18, that would be encountered on a winter morning.

In this configuration, room air element shaft 22*a* is in its fully retracted position, and axle arm 26 is in contact with stop screw 27. Jointed arm 32*a, b* is slightly broken, and arm link adjustment screw 42 acts as a second fulcrum point to upper joint 32*a*, resulting in the remote end of arm 32*a, b* moving slightly downward and lowering diffusion disk 14. This slight, but intentional, disk opening allows some small volume of supply air to flow from the central heating system to the diffuser. Without this design, the heated air can be "locked out" of the system, greatly increasing the response time of the heating mode.

When the supply air warms up, however, a new configuration takes place. FIG. 4*b* illustrates the response of supply air element 20 to this warm air. In such a condition, supply air element 20 extends its shaft down the inside of center post 16 and against pin 35. Pin 35 moves heating element actuator arm 36 about axis 38 so that arm 36 is raised up against the underside of jointed arm 32*a, b* at its joint axis 40. This raises arm 32*a, b* until its upper joint 32*a* contacts arm link adjustment screw 42, which stops further vertical movement of upper joint 32*a*. Continued upward lifting by actuator arm 36 against joint axis 40 "breaks" jointed arm 32*a, b* at joint axis 40, and arm link adjustment screw 42 acts as a second fulcrum point to upper joint 32*a*, resulting in the remote end of arm 32*a, b* moving relatively downward and lowering diffusion disk 14. This acts to enlarge discharge opening 18, allowing warm air to enter the room.

In the heating mode, the maximum size of discharge opening 18 can be adjusted by raising or lowering arm link adjustment screw 42. As can be appreciated by reference back to FIGS. 3*a* and 3*b*, such an adjustment will not affect the size of the maximum discharge opening when the system is in an air conditioning (cool supply air) mode. This feature enables the tailoring of the maximum amount of warm air discharged into the room in the heating mode which, in many situations, should be different than the maximum amount of cool air discharged into the room in the air conditioning mode. For example, it has been found that effective heating often requires only 50% of the volume of supply air of that needed for effective cooling. Most of the prior art units fail to address this fact, and supply the same volume of warm or cool air.

FIG. 4*c* illustrates the effect of the warming room air on room air element 22. As before, room air element 22 extends its shaft against axle arm 26, moving it and overload bracket 28 about axis 34. However, because lower joint 32*b* has moved relatively upward under the influence of arm 36, and overload bracket 28 is not in contact with set screw 30, such movement has no effect on jointed arm 32*a, b*, and thus no effect on the position of diffusion disk 14. The importance of this feature is that room air element 22 is, in a heating mode, prevented from affecting the preadjusted discharge opening discussed above, thereby avoiding the undesirable effects of prior art units.

Warm supply air will create a stratified temperature level at the ceiling. The stratified level will be at some temperature in excess of the comfort zone in the room. In the prior art units, when the ceiling temperature adjacent the room air element exceeds the setting of the room air element, that element reacts against its linkage, closing the discharge opening entirely, or first closing it and then reopening it, depending on the length of stroke remaining in the shaft of the room air element. This results in the all-or-nothing situation of either a cutting off of the needed warm air supply to the room, or the uncontrolled, full open discharge of warm air, eventually overheating the room. The inventive device, on the other hand, disengages the room air element, enabling the supply air element to move the diffuser opening to its preadjusted (limited) maximum position.

While this invention has been described in connection with preferred embodiments thereof, it is obvious that modifications and changes therein may be made by those skilled in the art to which it pertains without departing from the spirit and scope of this invention, as defined by the claims appended hereto.

What is claimed as invention is:

1. A thermally powered control mechanism for an air diffuser for discharging supply air into a room comprising:

output means for varying the size of the air diffuser discharge opening;

means for sensing the temperature of the room air;

means for sensing the temperature of the supply air;

linkage operatively connecting said room air temperature sensing means and said supply air temperature sensing means to said output means so that when the supply air temperature is cool, said room air temperature sensing means operates to decrease the size of said discharge opening when the room temperature cools, and to increase the size of said discharge opening when the room temperature warms; and when the supply air temperature is warm, said supply air temperature sensing means operates to disengage said room air temperature sensing means and to increase the size of said discharge opening.

2. The termally powered control mechanism of claim 1 wherein said linkage includes means for selectively limiting the size of the discharge opening when said supply air temperature is warm.

3. The thermally powered control mechanism of claim 1 wherein said linkage operates so that when the room temperature is cold, said discharge opening is slightly open.

* * * * *